US005871029A

United States Patent [19]

Peteri et al.

[11] Patent Number: 5,871,029

[45] Date of Patent: Feb. 16, 1999

[54] HOT WATER TAP

[76] Inventors: Henri Bernard Peteri, Rozenburglaan 31, 3062 EB; Niels Theodoor Peteri, Essenburgsingel 44b, 3021 AR, both of Rottendam, Netherlands

[21] Appl. No.: 808,914

[22] Filed: Feb. 28, 1997

[30] Foreign Application Priority Data

Feb. 28, 1996 [NL] Netherlands ..... 1002478

[51] Int. Cl.[6] ..... E03C 1/44

[52] U.S. Cl. ..... 137/801; 4/678; 137/615

[58] Field of Search ..... 4/678; 137/615, 137/801

[56] References Cited

U.S. PATENT DOCUMENTS

| | | | |
|---|---|---|---|
| 4,077,545 | 3/1978 | Karls | 137/801 |
| 4,457,342 | 7/1984 | Moen | 137/801 |
| 4,771,485 | 9/1988 | Traylor | 137/216 X |
| 4,884,596 | 12/1989 | Byers et al. | 137/801 |
| 5,009,247 | 4/1991 | Oberdorfer | 137/801 X |
| 5,404,898 | 4/1995 | Stowers | 137/218 |

*Primary Examiner*—Gerald A. Michalsky
*Attorney, Agent, or Firm*—Michael N. Meller

[57] ABSTRACT

A water tap for the purpose of dispensing hot water intended for arrangement on a horizontal face (3), comprising a shut-off cock (8) which is connectable, by an inlet (8*a*) thereof, to a hot-water source and connected, by an outlet thereof and via a water supply (12), to a pivotable discharge (2), of which discharge in inlet side comprises a straight length of tubing (5), the straight length of tubing (5) being clampingly arranged in a guide (1*a*, 1*b*, 16) of a tube guide housing (1) so that the discharge (2) is adjustable in the direction of the longitudinal center line of the straight length of tubing (5) and retains this position in any adjusting position under the influence of the clamping guide (1*a*, 1*b*, 16).

21 Claims, 2 Drawing Sheets

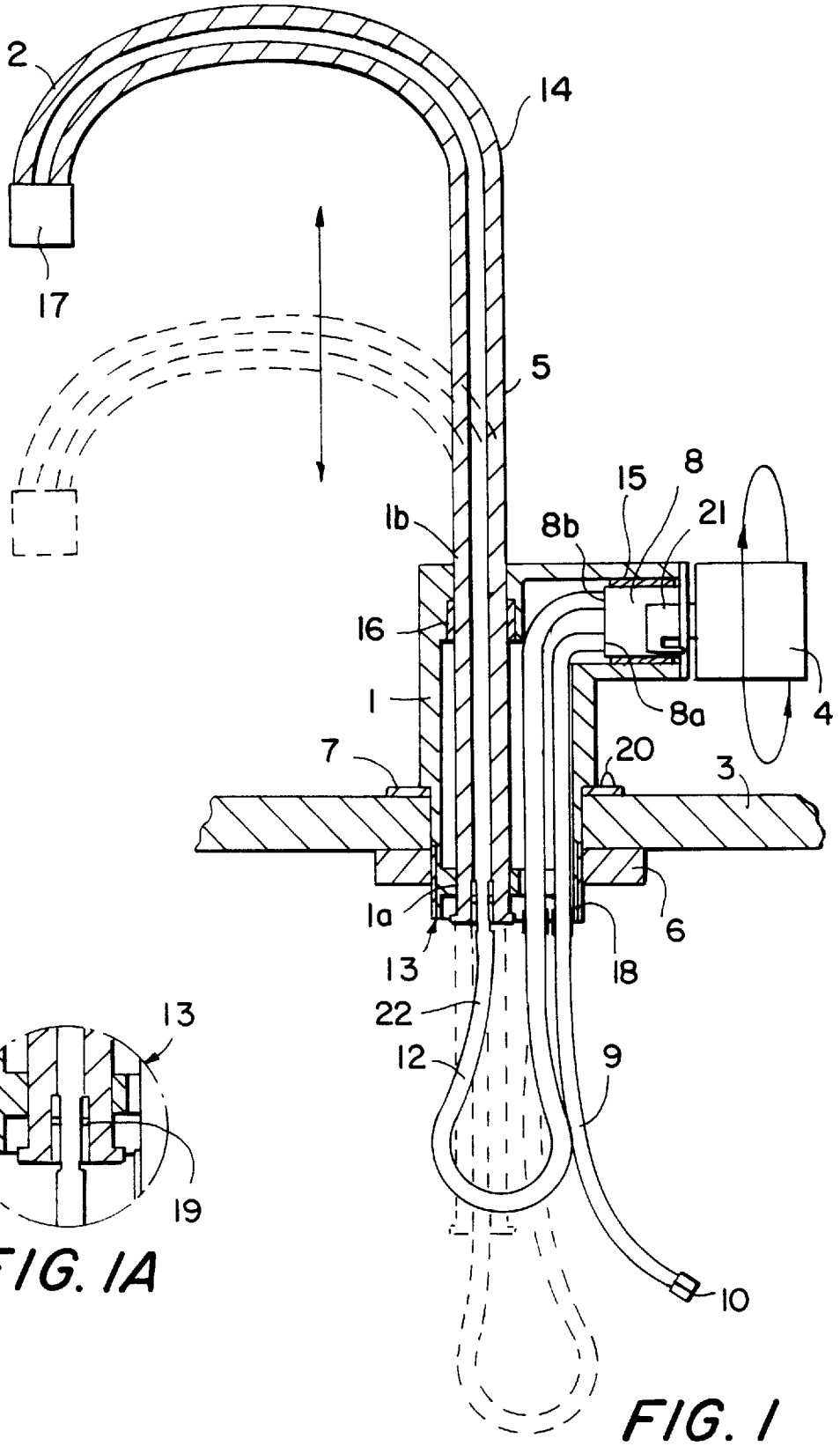
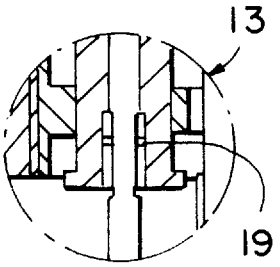
FIG. 1A
FIG. 1

HOT WATER TAP

The invention relates to a water tap intended for arrangement on a horizontal face, comprising a shut-off cock which is connectable, by an inlet thereof, to a water source and connected, by an outlet thereof and via a water supply, to a pivotable discharge, an inlet side of which discharge comprises a straight length of tubing, the straight length of tubing being clampingly arranged in a guide of a tube guide housing so that the discharge is adjustable in the direction of the longitudinal center line of the straight length of tubing and retains this position in any adjusting position under the influence of the clamping guide.

In the domestic water taps for dispensing hot water that are generally used, the water supply to the tap takes place from under the positioning face and the outflow takes place by means of a pivotable discharge.

In many cases, in a domestic kitchen, a mixing tap is present above the sink of the drainboard, whereby warm and cold water is mixed and whereby the mixed water flows out above the sink at the desired temperature. The height of the outflow opening of the discharge above the sink, which discharge is typically rotatable about a vertical axis, is in this case not very critical. It is true that there should be sufficient height to be able to wash one's hands under the jet, but even in the case of a high-positioned outflow opening, there is in fact no danger, not even with an effervescent jet, that a part of the water gets outside the sink. Moreover, with most mixing taps, such low temperatures are used that there is little danger of hot drops on the hands. Generally, the water tap in a kitchen is mainly used for washing hands and for rinsing and washing kitchenware.

An essentially different situation is created when a tap is to be used mainly for filling kitchenware containers at temperatures around the boiling point, for the consumption of hot beverages or for the preparation of hot food. An example of a provision for this manner of using hot water which, in practice, is widely employed, is given in U.S. Pat. No. 3,581,057. It is true that this publication relates to a method for preventing after-dripping through the tap discharge resulting from expansion of water during heating up, which is not the issue at present, but the arrangement of the discharge relative to the drainboard and the sink is illustrative. The housing on which the operating knob for the shut-off cock is provided and on which the tap discharge is disposed, is intended to be secured on the drainboard. In this manner, the outflow opening of the hot water is located above the sink, at only a slight height above the drainboard surface, so that the chance of water splashing on the hands is small. This use is especially suitable for filling cups having ears, which cups have to be held under the tap during filling. This last is in itself a drawback, because it is much easier to fill a cup or bowl that, during filling, can be disposed on the drainboard under the discharge, so that one hand remains free. Moreover, it is a drawback of a low discharge that the filling of high pans or thermos jugs is not properly possible. The filling of kitchenware containers is even more difficult when it concerns water that is heated above the atmospheric boiling point and, when leaving the outflow opening, flows out while generating vapor, causing a cooling to 100° C.

An example of a tap for this last-mentioned purpose is given in U.S. Pat. No. 5,343,552. This example concerns a tap especially used for boiling water, wherein it is required that the water, when flowing out, generates a relatively large amount of vapor, whereby volatile substances dissolved in the water can be distilled off. For the sake of the filling of high pans or thermos jugs, the tap discharge is positioned high above the drainboard. This inevitably involves the necessity of holding low cups or glasses under the discharge by hand, which, as a consequence of the vapor-generating, spraying jet, often leads to complaints about hot drops on the hand. The spraying of the jet is a serious drawback for domestic usage.

The solution to the problem was initially sought in the reduction of the spraying of the jet during flowing out. To this end, attempts have been made to effect a calmer separation of steam and water by means of cyclone action. However, it did not prove to be possible to render the cyclone of a small construction, so that inconvenience was suffered from after-dripping, while, also, the aim to minimize the initial flow of cold water was nullified. Moreover, it is very difficult to arrange a cyclone at the end of a slender discharge in an aesthetic manner.

The tap described in the opening paragraph, which is known from FR-A-990 965, provides the possibility of adjusting the discharge in the direction of the longitudinal center line of the straight length of tubing, with the discharge, under the influence of the clamping guide, retaining this position in any adjusting position. In itself, the tap known from FR-A-990 965 offers the possibility of setting the discharge at a short distance from the top edge of the kitchenware containers to be filled. This involves the straight length of tubing being selectively pressed more or less below the drainboard. The splashing of water is thus prevented.

An major drawback of the known tap, however, is that it is not suitable for tapping hot or boiling water, because of the fact that water flows round the discharge, and in particular the straight length of tubing thereof, on the outside as well as on the inside. Hence, when this water is hot or boiling, the length of tubing in an entirely or partly slid-in condition will also become scalding hot on the outside thereof, so that the user will scald himself on the length of tubing. Insulation of the length of tubing is moreover useless as the hot water contacts both the inside and the outside of the length of tubing.

The object of the invention is to provide a hot-water tap which has the advantages of the tap known from FR-A-990 965 and which is moreover suitable for tapping hot or boiling water without causing the danger of the user burning himself on the discharge when adjusting the height of the discharge.

To this end, the water tap of the type mentioned in the opening paragraph is characterized in that the water tap is intended for dispensing hot or boiling water, the water source being a hot-water source, the water supply comprising a flexible hose having a first end thereof rotatably connected to the discharge via a rotation coupling, and having a second end thereof connected to the outlet of the shut-off cock so as to be restrained from rotation, the flexible hose being sufficiently flexible to keep forming a loop without buckling during adjustment of the discharge, but still sufficiently rigid to undergo only a slight degree of torsion during rotation of the discharge.

A water tap of such construction offers the advantage that the discharge thereof is flown through by hot water only on the inside. The outside of the discharge does not directly contact the hot water. This permits the discharge to be gripped without the user scalding himself on the discharge. The flexible hose has a loop-shaped course, whereby the space is created to enable the adjustability in the direction of the center line of the straight length of tubing. In spite of the friction in the rotation coupling, which is for instance designed as an O-ring, the suitably chosen rigidity of the flexible hose prevents the hose from being squeezed close, caused by torsion, during rotation of the tap discharge. Hence, the tap discharge can be rotated endlessly without involving any problems.

To further limit the chance of the user burning his hands, in accordance with a further elaboration of the invention, it is particularly favorable when heat-insulating material is provided in the discharge and the tube guide housing.

In accordance with a further elaboration of the invention, the flexible hose is manufactured from TEFLON (PTFE). This synthetic material is resistant to water having a temperature of more than 100° C. Moreover, this material does not involve calcium precipitation. If necessary, the hose may be provided with a stainless-steel braided reinforcement.

Through variation in, inter alia, the hose thickness and the construction of the reinforcement, a flexible hose can be obtained having a suitable flexibility and sufficient torsion rigidity.

In accordance with a practical further elaboration of the invention, the guide is of vertical construction and the straight length of tubing is adjustable in vertical direction. Such vertical adjusting possibility provides a greatest possible height adjustment of the outflow opening of the discharge at a minimum length of the straight length of tubing.

In accordance with a further elaboration of the invention, the clamping can be realized by a spring arranged in the tube guide housing, which spring exerts a clamping force on the straight length of tubing. If necessary, an intermediate layer of, for instance, teflon may be provided between the spring and the straight length of tubing.

The shut-off cock may be separately arranged on the horizontal face, but may also be integrated into the tube guide housing. This latter possibility offers the advantage that the tap can be supplied as a single unit and that the assembly operations for fitting the tap are minimized.

A water tap that can readily be assembled is obtained when the tube guide housing has a downwardly directed end thereof provided with screw thread for cooperation with a fastening nut. This involves the possibility of fitting the tube guide housing, on which the fastening nut can be tightened, in a single round hole in the drainboard. The additional advantage hereof is that the tube guide housing can be secured in any desired position relative to a vertical axis through the center of the hole in the drainboard. Accordingly, the turning knob of the tap can be secured in the most accessible position relative to the sink, independently of whether the boiling-water tap is disposed on the left-hand side or on the right-hand side of the sink.

If necessary, the lower end of the tube guide housing may comprise a ring wherein, for instance, a signal lamp can be provided, which ring, during the assembly of the water tap, is rotatable into any desired position relative to the tube guide housing before the tube guide housing is secured.

To prevent splashing even further, for connecting the hot-water tap to a boiling-water device, the discharge can be provided, at its outflow opening, with a jet-regulating jet nozzle.

For safety reasons, in accordance with a further elaboration of the invention, the shut-off cock can comprise a safety precaution which precludes opening the shut-off cock straightforwardly. The safety provision can for instance be realized in that the shut-off cock comprises an operating knob which, for opening the shut-off cock, is rotatable in a depressed condition only.

Allowing for other possible embodiments, the invention will hereinafter be specified with reference to the accompanying drawings, wherein:

FIG. 1 is a cross-sectional view, taken on line I—I in FIG. 2, of an exemplary embodiment of a hot-water tap, as it is provided on a drainboard;

FIG. 1A is a detail view in cross section of the rotatable coupling 13 of FIG. 1.

Figure 2:
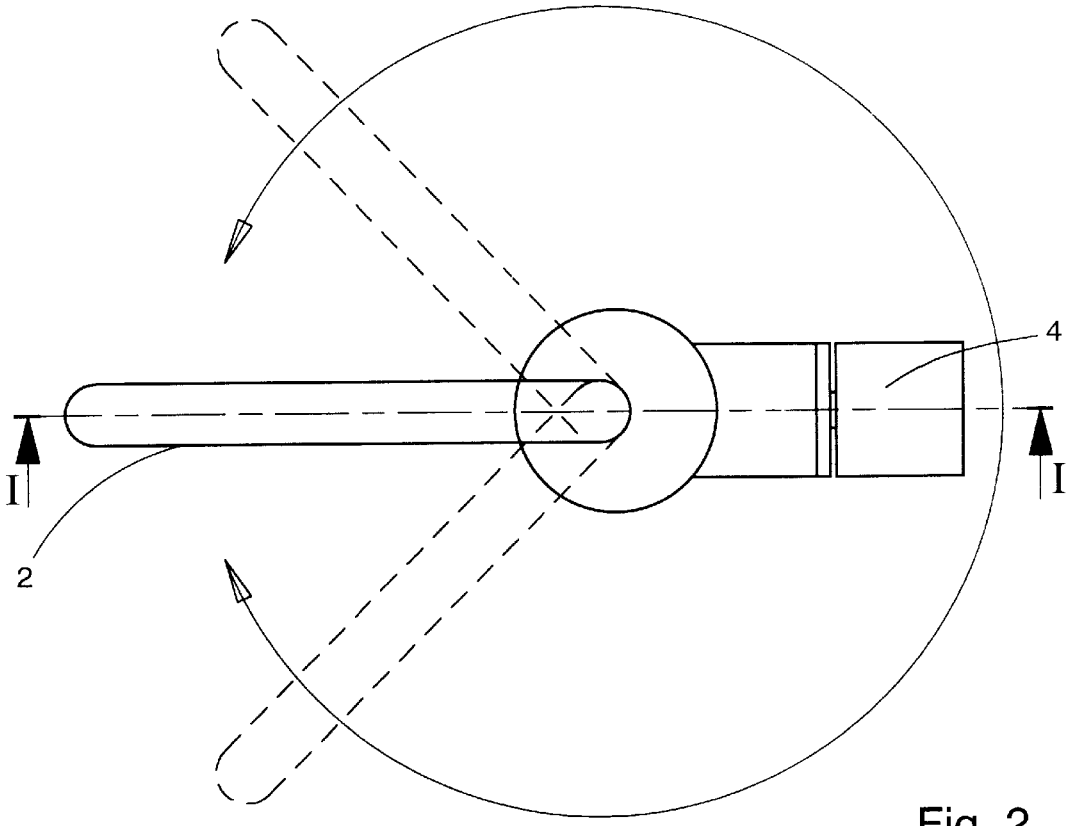
FIG. 2 is a top plan view of the hot-water tap shown in FIG. 1.

The exemplary embodiment shown of the hot-water tap comprises a shut-off cock 8 connectable by an inlet 8*a,* via a feed conduit 9, to a hot-water source and connected by an outlet 8*b,* via a water supply 12, to a pivotable discharge 2, an inlet side of which comprises a straight length of tubing 5. The straight length of tubing 5 is clampingly arranged in a guide 1*a,* 1*b* of a tube guide housing 1 so that the discharge 2 is adjustable in the direction of the center line of the straight length of tubing 5 and, under the influence of the clamping guide 1*a,* 1*b,* retains this position in any adjusting position.

The straight length of tubing 5 of the pivotable tap discharge 2 is rotatably arranged in the tube guide housing 1 so as to be slidable in vertical direction.

The guide 1*a,* 1*b* is of vertical design and the straight length of tubing 5 is adjustable in vertical direction. The guide 1*a,* 1*b* moreover comprises a spring 16 arranged in the tube guide housing 1, which spring exerts a clamping force on the straight length of tubing 5. The shut-off cock 8 is integrated into the tube guide housing 1. The clamping spring 16, accommodated in the tube guide housing and exerting pressure on the straight length of tubing 5 of the tap discharge 2, provides that the tap discharge can be moved relatively smoothly while yet retaining its position after each adjustment.

The connection between the water supply 12 and the discharge 2 comprises a rotatable coupling 13 having an O-ring 19 which permits rotation of the water supply 12 relative to the discharge 2 but guarantees a watertight sealing all the same.

The water supply, constructed as flexible hose 12, is sufficiently flexible to keep forming a loop that does not buckle during vertical adjustment of the discharge 2, and is also sufficiently rigid to undergo only a slight degree of torsion during rotation of the discharge 2, thus preventing closure of the water supply 12 through wrenching of the hose. The flexible hose 12 can be provided with a stainless-steel braided reinforcement 22 as shown in FIG. 1.

Provided in the discharge 2 and the tube guide housing 1 is heat-insulating material 14 and 15 respectively. At the tube guide housing 1, this insulation serves to limit the heat contact between the shut-off cock 8 and the tube guide housing 1.

At a downwardly directed end, the tube guide housing 1 is provided with screw thread 18 for cooperation with a fastening nut 6 for the purpose of assembling the water tap. The lower end of the tube guide housing 1 comprises a ring 7, wherein for instance a signal lamp 20 can be arranged, which ring 7, during the assembly of the water tap, can be rotated into any desired position relative to the tube guide housing 1 before the tube guide housing 1 is secured. Such a signal lamp can for instance serve to indicate that the boiling-water device connected to the hot-water tap is heating up. Obviously, it is also possible to provide the ring with a brand plate which, owing to the fact that the ring is rotatable, can be rotated so as to be properly within the user's view.

To minimize splashing and to effect a controlled separation of steam and water, for the connection of the tap to a boiling-water device it is particularly favorable when the discharge 2 has its outflow opening provided with a jet-regulating jet nozzle 17.

For reasons of safety, the shut-off cock 8 comprises an operating knob 4 which, for opening the shut-off cock 8, is rotatable in a depressed condition only. That is, the internal portion 21 of the shut-off cock 8 requires the knob 4 to be depressed prior to rotation.

The lower portion of the tube guide housing 1 has the shape of a short length of wide tube which provides space for passing the straight length of tubing 5 of the tap discharge 2 and for the feed conduit 9 and the water supply 12.

On this tubular part, which was passed through a round hole in the drainboard 3, the fastening nut 6 can be provided whereby the tube guide housing 1 is clamped against the drainboard 3. The advantage of this construction is that the housing 1 on which, in the present case, the operating knob 4 for the shut-off cock 8 is provided as well, can be fitted in any desired direction, before the housing is secured, independently of the location of the tap relative to the sink. After the housing 1 has been mounted on the drainboard 3, the feed conduit 9 can have its the connecting opening 10 connected to the water supply system.

It is understood that the invention is not limited to the exemplary embodiment described, but that various modifications are possible within the framework of the invention. For instance, a separate arrangement of the shut-off cock 8 and the tube guide housing 1 can also be opted for. Although this results in slightly more assembly work, such a construction is however sometimes preferred for aesthetic reasons.

We claim:

1. A water faucet adapted to be mounted on a horizontal surface (3) of a sinktop through a single opening with said faucet comprising: a single spout (2) having a curved open end for discharging hot or boiling water and a straight length of tubing (5) extending to the opposite end thereof, a tube guide housing (1) to be affixed to the single opening in the sinktop through which said straight length of tubing (5) extends with said tube guide housing (1) having guide means **(1*a*,1*b*,) to permit the straight length of tubing (5) to be vertically adjusted and clamp means (16) to permit the curved open end of said spout (2) to be retained in any vertically adjusted position relative to the sinktop, a shut-off valve (8) incorporated in said tube guide housing (1) with said valve (8) having an inlet (8*a*) connected to a hot water source,and an outlet (8*b*), a flexible hose (12) for connecting said outlet (8*b*) to said straight length of tubing (5) at said opposite end of said spout (2) so that said flexible hose forms a loop between said valve outlet (8*b*) and said straight length of tubing (5), and coupling means for rotatably coupling said flexible hose to the straight length of tubing (5) to allow the straight length of tubing (5) to rotate relative to said hose such that the spout may be turned without twisting or buckling the flexible hose (12)** during rotation or vertical adjustment of the spout.

2. A water faucet according to claim 1, wherein heat-insulating material (14, 15) is provided in the spout (2) and the tube guide housing (1).

3. A water faucet according to claim 2 wherein the flexible hose (12) is manufactured from TEFLON (PTFE).

4. A water faucet according to claim 2 wherein the flexible hose (12) is provided with a stainless-steel braided reinforcement.

5. A water faucet according to claim 2 wherein the guide **(1*a*, 1*b*) is of vertical construction and the straight length of tubing (5)** is adjustable in vertical direction.

6. A water faucet according to claim 2 wherein a spring (16) arranged in the tube guide housing (1), said spring (16) exerting a clamping force on the straight length of tubing.

7. A water faucet according to claim 2 wherein the shut-off valve extends from the tube guide housing (1).

8. A water faucet according to claim 2 wherein the tube guide housing (1) has a downwardly directed end thereof provided with screw thread (18) for cooperation with a fastening nut (6) for the assembly of the water tap.

9. A water faucet according to claim 2 for connection to a boiling-water device, the discharge (2) is provided with a jet-regulating jet nozzle (17).

10. A water faucet according to claim 2 wherein the shut-off valve comprises a safety precaution which precludes opening the shut-off valve (8) straightforwardly.

11. A water faucet according to claim 1 wherein the flexible hose (12) is manufactured from TEFLON (PTFE).

12. A water faucet according to claim 1 wherein the flexible hose (12) is provided with a stainless-steel braided reinforcement.

13. A water faucet according to claim 1 wherein the guide **(1*a*, 1*b*) is of vertical construction and the straight length of tubing (5)** is adjustable in vertical direction.

14. A water faucet according to claim 1 wherein a spring (16) arranged in the tube guide housing (1), said spring (16) exerting a clamping force on the straight length of tubing.

15. A water faucet according to claim 1 wherein the shut-off cock (8) is integrated into the tube guide housing (1).

16. A water faucet according to claim 1 wherein the tube guide housing (1) has a downwardly directed end thereof provided with screw thread (18) for cooperation with a fastening nut (6) for the assembly of the water tap.

17. A water faucet according to claim 16, wherein the lower end of the tube guide housing (1) comprises a ring (7) wherein a signal lamp is provided, which ring (7), during the assembly of the water tap, is rotatable into any desired position relative to the tube guide housing (1) before the tube guide housing (1) is secured.

18. A water faucet according to claim 1 wherein, for connection to a boiling-water device, the discharge (2) is provided with a jet-regulating jet nozzle (17).

19. A water faucet according to claim 1 wherein the shut-off cock comprises a safety precaution which precludes opening the shut-off cock (8) straightforwardly.

20. A water faucet according to claim 19, wherein the shut-off cock (8) comprises an operating knob (4) which, for opening the shut-off cock (8), is rotatable in a depressed condition only.

21. A water faucet according to claim 1 wherein said coupling means comprises an O-ring.

* * * * *